US005761769A

United States Patent [19]

Brückner et al.

[11] Patent Number: 5,761,769

[45] Date of Patent: Jun. 9, 1998

[54] DOOR HINGE FOR A MOTOR VEHICLE DOOR WITH A BRAKING AND RETAINING FUNCTION

[75] Inventors: Lothar Brückner, Leonberg; Dietmar Franke, Remscheid; Uwe Kirsten, Witten, all of Germany

[73] Assignee: ED. Scharwachter GmbH & Co. KG, Remscheid, Germany

[21] Appl. No.: 751,197

[22] Filed: Nov. 15, 1996

[30] Foreign Application Priority Data

Jan. 3, 1996 [DE] Germany ..... 196 00 063.7

[51] Int. Cl.[6] ..... E05C 17/64

[52] U.S. Cl. ..... 16/342; 16/386

[58] Field of Search ..... 16/342, 339, 329, 16/330, 386, 337, 376, 273, 296

[56] References Cited

U.S. PATENT DOCUMENTS

| | | | |
|---|---|---|---|
| 1,847,937 | 3/1932 | Fetters | 16/339 |
| 2,458,707 | 1/1949 | Jacobs | 16/386 |
| 2,504,351 | 4/1950 | Ring | 16/342 |
| 3,000,049 | 9/1961 | Terry, Jr. | 16/386 |
| 4,329,758 | 5/1982 | Fohl | 16/273 |
| 4,353,146 | 10/1982 | Brockhaus | 16/385 |
| 4,475,266 | 10/1984 | Suska | 16/386 |
| 4,528,718 | 7/1985 | Brockhaus | 16/342 |
| 4,675,940 | 6/1987 | Brockhaus | 16/385 |
| 5,577,295 | 11/1996 | Papke et al. | 16/386 |

FOREIGN PATENT DOCUMENTS

| | | | |
|---|---|---|---|
| 0382170 | 8/1990 | European Pat. Off. | 16/273 |

*Primary Examiner*—Chuck Mah

*Attorney, Agent, or Firm*—Anderson, Kill & Olick, P.C.

[57] ABSTRACT

A door hinge for a motor vehicle door provided with a braking and retaining function, and including two hinge halves and a hinge pin extending through gudgeons of the two hinge halves for pivotally connecting the hinge halves together, with the hinge pin being secured in a gudgeon of one of the hinge halves against rotation and extending through a gudgeon of another of the hinge halves with a clearance, the hinge pin and bore of the gudgeon of another of the hinge halves having at least along a portion of their common axial extent, complementary, circumferential regions the circularity of which deviates from a regular circular cross-section of their complementary cylindrical surfaces.

20 Claims, 4 Drawing Sheets

DOOR HINGE FOR A MOTOR VEHICLE DOOR WITH A BRAKING AND RETAINING FUNCTION

BACKGROUND OF THE INVENTION

1. Field of the Invention

The present invention relates to a door hinge for a motor vehicle door, which has braking and retaining functions and which includes two hinge halves attachable, respectively, to the vehicle door and the door pillar associated with the door, and a hinge pin extending through gudgeons of the two halves for pivotally connecting the hinge halves, with the hinge pin being secured in a gudgeon of one of the hinge halves against rotation and extending through a gudgeon of another of the hinge halves with a clearance.

2. Description of the Prior Art

In door hinges of the above-described type, for obtaining a braking and retaining function, the hinge pin is secured against rotation in the gudgeon(s) of one of the hinge halves and a portion of the hinge pin, which extends with a running fit in the gudgeon of the other of the hinge halves, is provided with a radially extending wedging surface which cooperates with a complimentary wedge surface provided in the gudgeon bore of the other hinge half, with both wedge surfaces having the same gradient and forming together a pair of wedge surfaces which abut each other along their entire overlapping region. A door hinge of this type is disclosed in German Patent No. 4,406,824. In this type of a door hinge, the wedge surfaces should be very flat with steeply inclined sides. Forming such surfaces increases production costs of both the hinge pin and the respective hinge half, primarily because of the required high precision with which the surfaces should be formed to provide for adequate braking and retaining function, on one hand, and because of a need to prevent premature wear and to eliminate a possible environmental influence. Forming door hinges with high-precision wedge surfaces is especially important when the hinges are used for door of commercial and utility motor vehicles. This is because, on one hand, the doors have a comparatively high weight and, on the other hand, the door are subjected to action of high kinetic forces both at door opening and at door closing, which are accompanied by a high acceleration.

In another type of a door hinge designed for a totally different use, namely, in furniture hinges, for obtaining an integrated braking and retaining function, the hinge pin portion, which extends through a hinge gudgeon with a running fit, has an oval cross-section cooperating with the complimentary oval bore of the hinge gudgeon. Such a hinge is disclosed in German Utility Model No. 76-16362. The desired or necessary braking and retaining function in this type of a hinge is achieved by forming the inner circumference of the oval bore as a resiliently deformable surface. To this end, the gudgeon with the oval bore is slotted in a radial direction so that the gudgeon is formed of two arms, expanding relative to each other, which envelope the hinge pin with a resilient prestress, with the braking and retaining force being dependent on the resiliency of the hinge gudgeon arms. However, a door hinge with a braking and retaining function obtained by slitting hinge gudgeon, is not suitable for use in motor vehicle doors. It is unsuitable because the maximal braking and retaining force obtained in such a hinge is not sufficient for braking and retaining a vehicle door in an open position because of a relatively large weight of a motor vehicle door and its kinetic energy. It is also unsuitable because it does not provide a sufficient protection against bad weather conditions and other environmental influences. This hinge also does not provide a sufficient protection against dirt contamination. Because of the slotted shape of the hinge gudgeon, the hinge is not suitable for motor vehicle doors.

Accordingly, an object of the present invention is a door hinge for a motor vehicle door with a braking and retaining function which insures, in a predetermined opening angle of the door, resistance-free opening and closing of the door and insures, in a region of a selected opening angle of a further opening movement of the door, a sufficiently high, progressively increasing resistance to the opening movement of the door.

Another object of the present invention, is a door hinge for a motor vehicle door which insures a maintenance-free noiseless operation thereof.

Yet another object of the present invention is a door hinge for a motor vehicle door having an infinite fatigue strength.

Still another object of the present invention is a door hinge for a motor vehicle door having small dimensions and which can be produced with relatively low costs.

SUMMARY OF THE INVENTION

These and other objects of the present invention, which will become apparent hereinafter, are achieved by providing a hinge in which the hinge pin and a bore of the gudgeon of the hinge half in which the hinge pin extends with a running fit, both have, at least along a portion of a common axial extent of the hinge pin and the gudgeon bore, complementary circumferential axially extending regions the circularity of which deviates from a regular circular cross-section of complementary cylindrical surfaces of the hinge pin and the gudgeon bore and which form continuous arcuate surfaces with adjacent associated sections of the complementary cylindrical surfaces of the hinge pin and the gudgeon bore.

Generally, viewing from a knurled section provided in the head region, a hinge pin has a regular cylindrical circumferential surface, but even in the region of its not exactly cylindrical axial portion, the hinge pin has a continuous circumferential surface. In particular, the circularity deviation regions of both the hinge pin and the gudgeon bore lie advantageously within limits of a contemplated circularity error so that the largest deviation from a circle lies within a region from less than one tenth to less than one hundredth of the diameter of the hinge pin. Advantageously, it is contemplated that the extending radially outwardly complementary circumferential regions of both the hinge pin and the gudgeon bore have circularity deviations, respectively, which lie, in their common axial region, between one hundredth and about one tenth of the hinge pin diameter. A continuous circumference of the hinge pin in the axial region of its not exactly cylindrical cross-section provides, on one hand, for relatively easy manufacturing of both the hinge pin and the gudgeon bore and, on the other hand, insures a smooth continuous increase in resistance in the hinge against further opening movement of the door in a predetermined angle of the door opening.

According to one aspect of the present invention, it is contemplated that both the gudgeon bore and the hinge pin have at least two opposite circularity deviation regions projecting radially outwardly with respect to their cylindrical circumferences, respectively.

According to a preferred embodiment of the present invention, in order to provide for ever increasing resistance of the hinge to the door opening movement in a selected angular region of the door opening, the hinge pin is provided over its circumference with two opposite, extending radially outwardly, circularity deviation regions, with the farthest points lying diametrically opposite each other and limiting an arc of 180°.

Accordingly to a further development of the present invention, it is provided that a straight line, which passes through the farthest points of the two circularity deviation regions, extends at an angle of 90° with respect to a straight line passing through attachment points and hinge eyelets.

Because a desired opening angle, at which further door opening movement need be prevented, changes from one vehicle type to another vehicle type, an angle different from 90° between a straight line connecting the farthest points of the two opposite circularity deviation regions and the attachment basis of a hinge half can be selected. Also, dependant on the size of the predetermined angle of resistance-free movement of the door, it can be provided that the two circularity deviations regions do not lie opposite each other but form between them an angle less than 180°.

According to the invention, the hinge pin can have, along a portion thereof received with a running fit in the gudgeon bore, only one circularity deviation region. At that, in view of production consideration of forming of the gudgeon bore and assembly of the hinge, it proved advantageous to dimension the axial portion of the hinge pin having the circularity deviation so that it equals at least one third of the total axial length of the associated gudgeon. At that, it is contemplated that this axial portion of the hinge pin has, on opposite sides of the circularity deviation region, a circular cross-section. The radial clearance between the hinge pin and the gudgeon bore in the region of the axial portion of the hinge pin with the circularity deviation should be a half or less of the maximal radial extent of the circularity deviation. At that, a larger clearance is contemplated for a hinge pin having a larger diameter.

According to the preferred embodiment of the invention, to insure a noiseless operation of the hinge, the hinge pin has, on opposite axial sides of the portion thereof provided with circularity deviations, opposite sections having a circular cross-section, and two bearing sleeves are provided for supporting the opposite sections in respective portions of the bore of the gudgeon of the bearing half in which the hinge pin extends with a clearance. The bearing sleeves are formed of maintenance-free bearing material. The advantage of providing bearing sleeves consists in that, on one hand, there is provided an absolutely backlash-free support of the hinge pin along its complete pivoting angle and, on the other hand, a total protection of the portion of the hinge pin with the circularity deviations from environmental influences. Advantageously, the bearing sleeve has a thickness at least equal to the maximal radial extension of the circularity deviation of the hinge pin. The axial length of the bearing sleeve, which preferably is formed as a collar sleeve, equals at least one fourth and preferably more, of the largest hinge pin diameter to insure a reliable maintenance-free support of the hinge pin in the resistance-free region of the opening angle of the door. Further, a complimentary portion of the gudgeon bore has a circumferential continuous wall having a minimal thickness equal at least twice of a circularity deviation of the hinge pin.

According to a further development of the present invention, the hinge pin has, at least along a portion thereof having a circularity deviation region, a wear-resistant layer of a material selected from a group of materials consisting of carbides, nitrites and carbonitrides. Alternatively, the wear-resistant layer may be formed by a ceramic layer or a refined ion implanted layer, or a combination of above-discussed layers. The wear-resistant layer may also be formed of a solid lubricant such as MoS2, PTFE, graphite, lead, or carbide.

According to another development of the present invention, when a split hinge is used, the hinge may include means for preventing axial displacement of the hinge pin. The preventing means is formed of a radial projection and a safety washer located on opposite axial sides of a hinge pin portion received in the gudgeon of the hinge half. There is further provided a clamp sleeve for retaining the hinge pin against rotation in the gudgeon in the hinge half, in which the hinge pin should be secured against rotation.

According to a further embodiment of the present invention one of the hinge halves is formed with two spaced gudgeons, and another of the hinge halves is formed with a single gudgeon located between the spaced gudgeons of the one hinge half, and the hinge pin is secured against rotation in both gudgeons of the one hinge half.

Finally, according to a yet another embodiment of the present invention, the hinge pin may have along an axial length thereof following one another stepped portions of ever increasing diameter, with a leading or driving end portion having the smallest diameter.

BRIEF DESCRIPTION OF THE DRAWINGS

The features and objects of the present invention will become more apparent, and the invention itself will be best understood from the following detailed description of the preferred embodiments when read with reference to the accompanying drawings, where.

DETAILED DESCRIPTION OF THE PREFERRED EMBODIMENT

Figure 2:
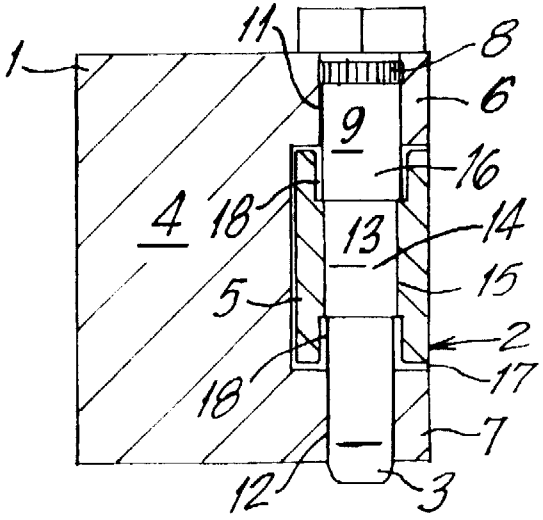
FIG. 2 is a longitudinal cross-sectional view of the vehicle door hinge shown in FIG. 1.

A vehicle door hinge according to the present invention, which is shown in the drawings, includes a first hinge half 1, which is attached to one of the door arrangement parts, the door or the door pillar, a second hinge half 2, which is attached to another of the door arrangement parts, and a hinge pin 3 which pivotally connects the first and second hinge halves 1 and 2 with each other.

Figure 1:
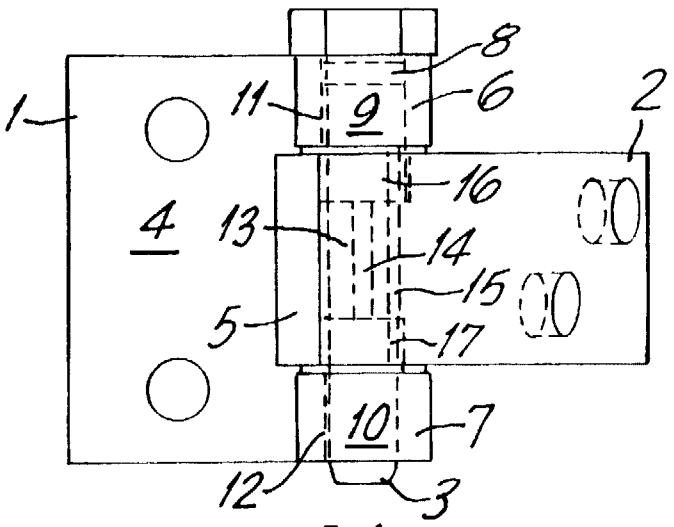
FIG. 1 is a side view of a first embodiment of a vehicle door hinge, provided with braking and retaining function according to the present invention.
Figure 3:
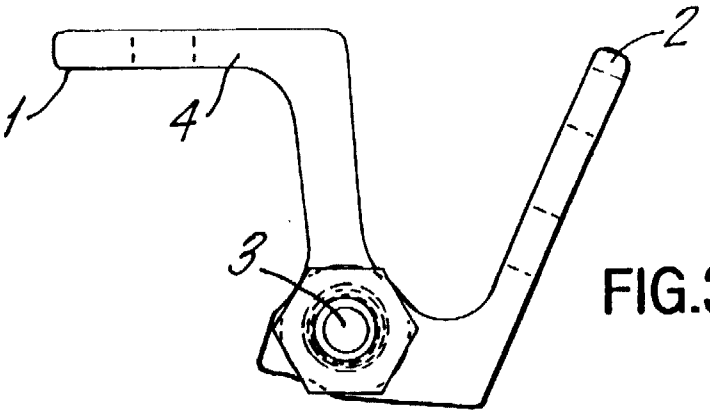
FIG. 3 is a plan view of the vehicle door hinge shown in FIGS. 1 and 2.

The hinge plate 4 of the first hinge half 1, which is shown in FIGS. 1–3, has two gudgeons 6 and 7 which grip, in a fork-like manner, a middle gudgeon 5 of the second hinge half 2. The hinge pin 3, which pivotally connects the two hinge halves 1 and 2 is secured in the gudgeon 6 of the first hinge half 1 against rotation by a circumferential knurled band 8 provided in the head portion of the hinge pin 3. The longitudinal portions 9 and 10 of the hinge pin 3, which extend through the gudgeons 6 and 7 of the first hinge half 1, have a smooth cylindrical surface. The gudgeons 6 and 7 of the first hinge half 1 have complimentary cylindrical bores 11 and 12, respectively for receiving the portions 9 and 10, respectively, of the hinge pin 3. The middle portion 13 of the hinge pin 3, which is received within the gudgeon 5 of the second hinge half 2, has generally a cylindrical shape and two opposite circumferential regions 14 extending radially outwardly with respect to the cylindrical surface of the hinge pin 3 and having a circularity which deviates from a regular circular cross-section. The bore of the gudgeon 5 is shaped so that it accommodates the circularity deviation regions 14. The axial length of the middle portion 13 of the hinge pin 3 is less than the axial height of the gudgeon 5, so that the hinge pin 3 is provided with two axial cylindrically-shaped sections 16, 17 with which the hinge pin 3 is rotatably supported, backlash-free, in bearing sleeves 18 formed of a maintenance-free bearing material. The bearing sleeves 18 are formed parts as collar sleeves and have a length which is less than a diameter of the hinge pin 3. The hinge pin 3 has, along its length, following each other portions of different diameters such that the diameter at its leading end is the smallest and the diameter of its head section is the largest.

Figure 5:
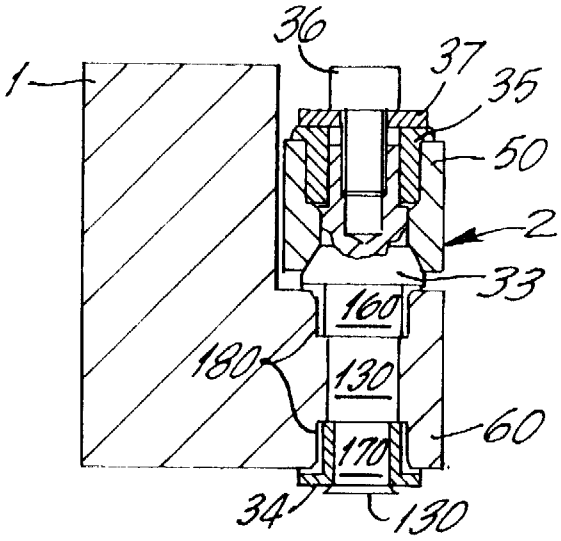
FIG. 5 is a longitudinal cross-sectional view of the vehicle door hinge shown in FIG. 4.
Figure 4:
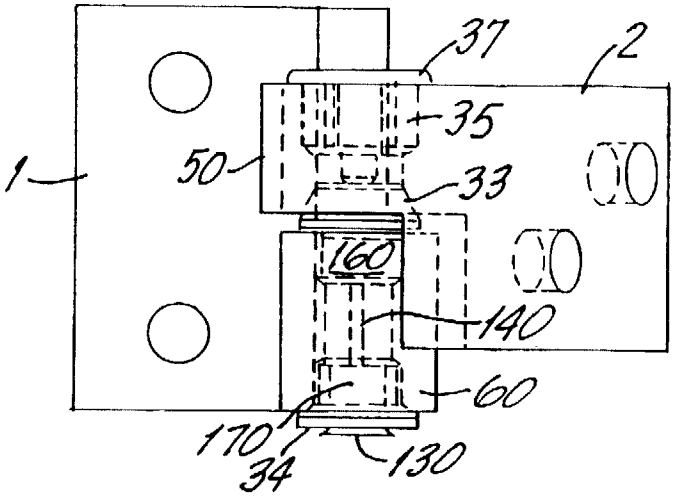
FIG. 4 is a side view of a second embodiment of a vehicle door hinge, provided with braking and retaining function, according to the present invention.
Figure 6:
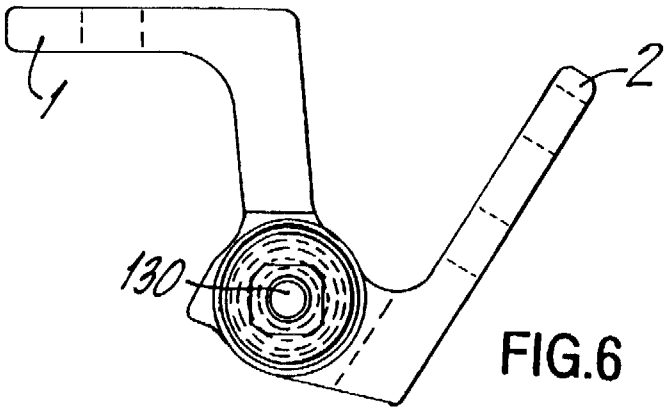
FIG. 6 is a plan view of the vehicle door hinge shown in FIGS. 4 and 5.

The hinge shown in FIGS. 4–6 is formed as a split hinge, with the each hinge half 1 or 2 having only one gudgeon 60 or 50. In this embodiment, the hinge pin 30 is rotatably supported in the gudgeon 60 of the first hinge half 1 and has, along its portion 130, which is received within the gudgeon 60, extending radially outwardly, circularity deviation regions 140. The hinge pin 30 is provided, on opposite axial ends of the axial portion 130 with cylindrical sections 160, 170, with which the hinge pin 30 is rotatably supported, backlash-free, in a collar-shaped bearing sleeves 180 formed of a maintenance-free bearing material and which support the hinge pin 30 in the gudgeon 60 of the first hinge half 1. As in the embodiment of the hinge shown in FIGS. 1–3, the axial length of the bearing sleeves 180 is less than the hinge pin diameter. Outwardly extending radial projection 33 and a washer 34 prevent the hinge pin 30 from axial displacement in the gudgeon 60 of the first hinge half 1. A positive clamp sleeve 35 secures the hinge pin 30 in the gudgeon 50 of the second hinge half 2 against rotation therein. The positive clamp sleeve 35 form-lockingly engages the hinge pin 30, on one hand, and the bore of the gudgeon 50, on the other hand. The clamp sleeve 35 is retained on the hinge pin 30 with a bolt 36 and a washer 37.

Figure 7:
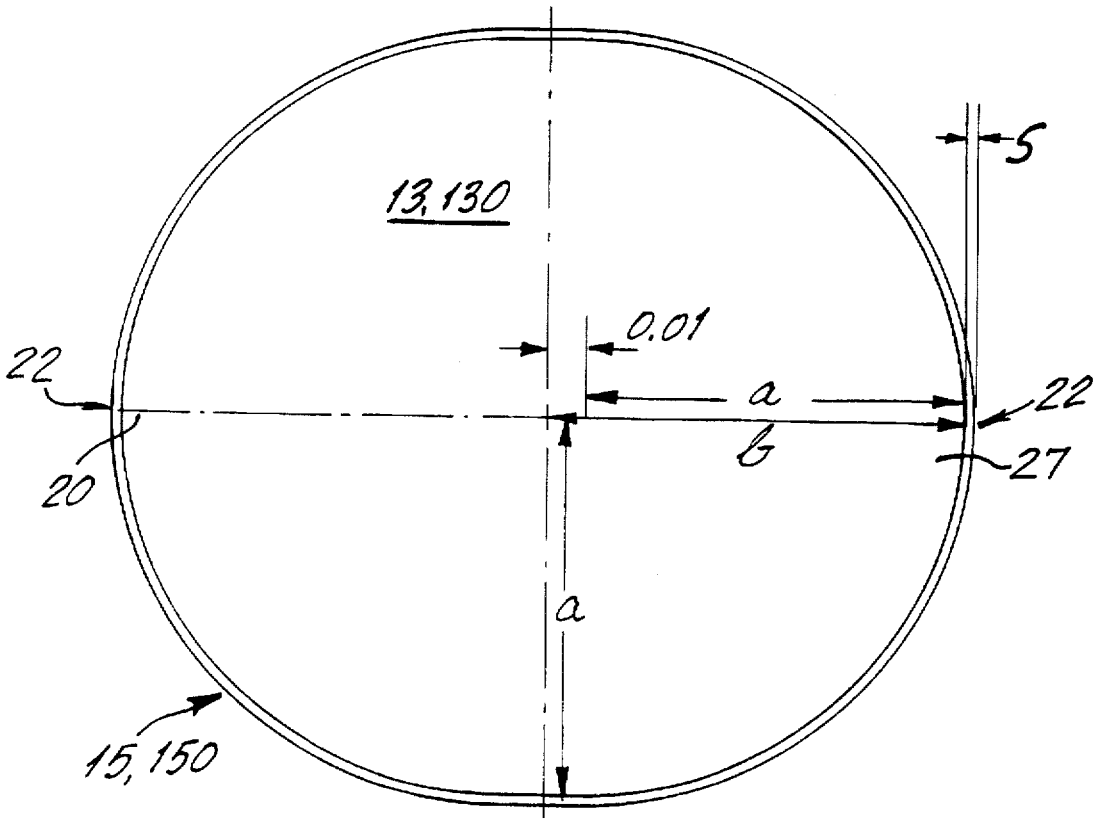
FIG. 7 is a view showing at an increased scale, a radial circularity deviation region of a hinge pin and a corresponding bore of the hinge gudgeon.
Figure 8:
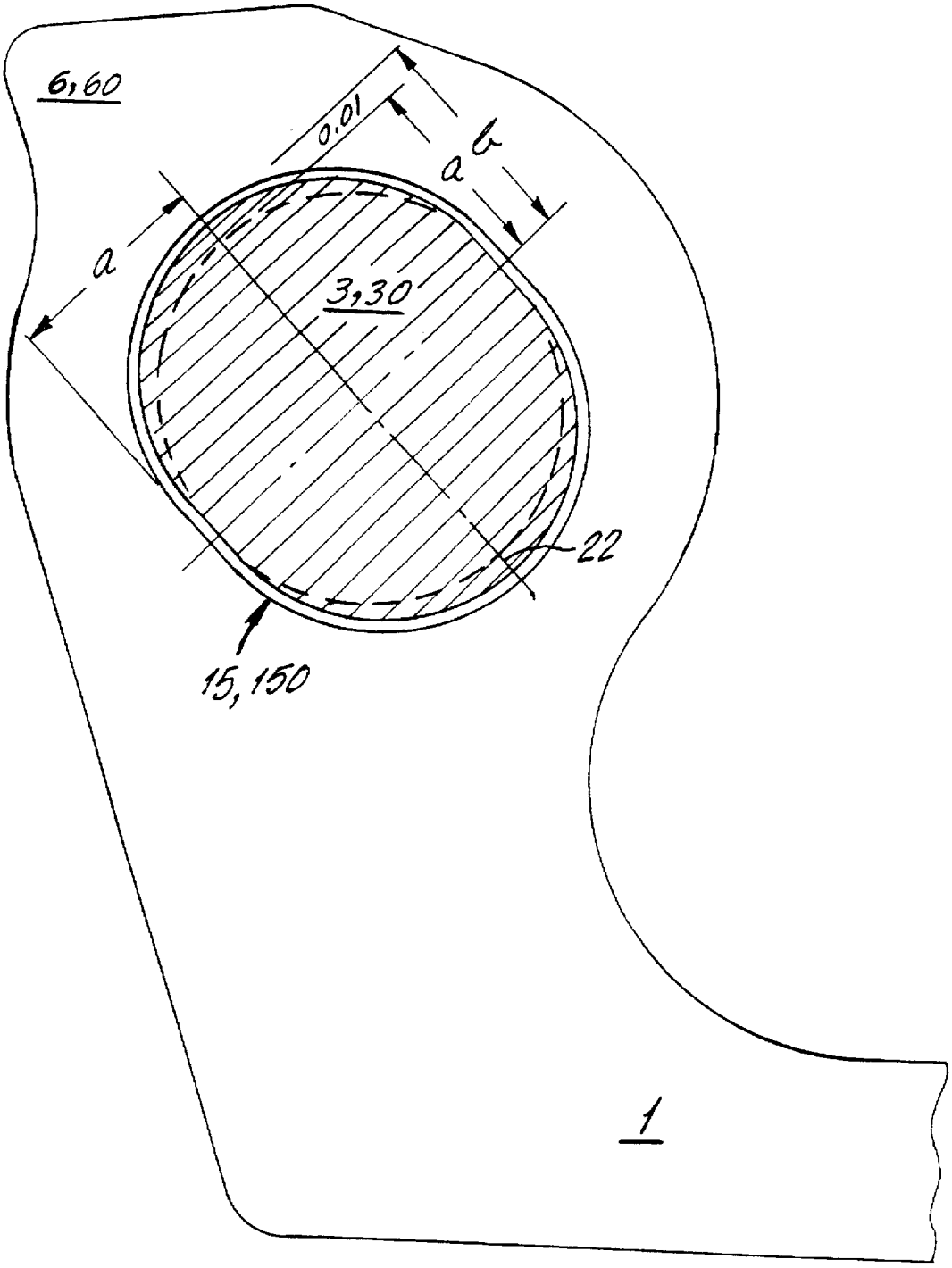
FIG. 8 is a cross-sectional view showing an area of a hinge head of a second hinge half.

In both embodiments of the door hinge for a motor vehicle according to the present invention, the braking and locking means for retaining the hinge in at least one selected opening position has the same structure. This means forms an integral part of the hinge. As shown in FIGS. 7 and 8, the cross-sections of the hinge pin 3 and 30 and of the complimentary gudgeon bores 15 and 150 have, along the axial portions 13 and 130, two, extending radially outwardly, circularity deviation regions 20 and 21. In the most outwardly located point 22 of the deviation regions 20 and 21, the deviation regions have a dimension from hundredths of a mm to tenths of a mm. With a hinge pin diameter of 8 mm, the radius in the point 22 will be equal from b=a+0.01 mm to b=a+0.5 mm. The clearance s between the outer circumference of the hinge pin and the inner circumference of the hinge gudgeon bore lies in the region between 0.005 and 0.2 mm. Both the hinge pin circumference and the gudgeon bore circumference, while not strictly circular, have a continuous stepless cross-section.

As shown in FIG. 8, the two opposite farthest points 22 of the two circularity deviations 20, 21 of the hinge pins 3 and 30 define together a circumferential arc of 180°. At the same time, a straight line g, which passes through both points 22 forms an angle of 90° with a line passing through points of stops limiting the pivotal movement of the second hinge half.

The hinge gudgeons 5 and 50 have, in the region of their bores corresponding to the circularity deviation region 20, 21 of the portions 13 and 130 of the hinge pins 3 and 30, respectively, a circumferential continuous wall, with the minimal wall thickness in this region being equal at least twice of the circularity deviation of the hinge pin.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A door hinge for a motor vehicle door and provided with a braking and retaining function, the door hinge comprising:

a first hinge half attachable to one of a door and a door pillar;

a second hinge attachable to another of the door and the door pillar; and a hinge pin extending through gudgeons of the first and second hinge halves for pivotally connecting the first and second hinge halves together, the hinge pin having generally a regular cylindrical circumferential surface, wherein the hinge pin is secured in a gudgeon of one of the first and second hinge halves against rotation and extends through a bore of a gudgeon of another of the first and second hinge halves with a clearance, and wherein the hinge pin and the bore of the gudgeon of another of the first and second hinge halves both have, at least along a portion of a common axial extent thereof, complementary, circumferential axially extending regions the circularity of which deviates from a regular circular cross-section of complementary cylindrical surfaces of the hinge pin and the gudgeon bore and which form continuous arcuate surfaces with adjacent associated sections of the complementary cylindrical surfaces of the hinge pin and the gudgeon bore, thereby to insure a smooth continuous increase in resistance in the hinge against further opening movement of the door in a predetermined angle of the door opening.

2. A door hinge as set forth in claim 1, wherein a circularity deviation of the hinge pin lies in a region between hundredths and tenths of a hinge pin diameter.

3. A door hinge as set forth in claim 1, wherein the complimentary circumferential circularity deviation regions of both the hinge pin and the gudgeon bore extend radially outwardly with respect to the complementary cylindrical surfaces thereof.

4. A door hinge as set forth in claim 1, wherein the hinge pin has, over a circumference thereof, two opposite circumferential circularity deviation regions extending radially outwardly with respect to the pin cylindrical surface.

5. A door hinge as set forth in claim 4, wherein the circularity deviation regions are provided diametrically opposite each other.

6. A door hinge as set forth in claim 4, wherein the farthest points of the two circularity deviate regions are located at an angle relative to each other with respect to the pin cylindrical surface.

7. A door hinge according to claim 1, wherein the circularity deviation regions of the hinge pin are provided along an entire length thereof.

8. A door hinge as set forth in claim 1, wherein the hinge pin has at least one circularity deviation region extending radially outwardly with respect to the pin cylindrical surface.

9. A hinge as set forth in claim 8, wherein an axial extent of the extending radially outwardly circularity deviation region is equal at least one third of entire axial length of the gudgeon of the another of the first and second hinge halves.

10. A door hinge as set forth in claim 1, wherein the hinge pin has, on opposite axial sides of an axial portion thereof provided with circularity deviation regions sections having axial a circular cross-section.

11. A door hinge as set forth in claim 10, further comprising two bearing sleeves formed of maintenance free bearing material for supporting the opposite sections in respective portions of the bore of the gudgeon of the another of the first and second bearing halves.

12. A door hinge as set forth in claim 11, wherein the bearing sleeves have a thickness at least equal to a maximal radial extension of the circularity deviation of the hinge pin.

13. A door hinge as set forth in claim 11, wherein the bearing sleeves are formed as collar sleeves and have an axial length equal at least one fourth of a largest diameter of the hinge pin.

14. A door hinge as set forth in claim 1, wherein the hinge pin has, at least along a portion thereof having the circularity deviation regions, a wear-resistant layer of a material selected from a group of materials consisting of carbides, nitrites, carbonitrides, formed by boride hard chromium plating, formed by a ceramic layer, formed by refined ion implanted layer or a combination of above-discussed layers.

15. A door hinge as set forth in claim 1, wherein the hinge pin has, at least along a portion thereof having the circularity deviation regions, a wear-resistant layer formed of a solid lubricant selected from a group consisting of MoS2, PTFE, graphite, lead, and cadmium.

16. A door hinge as set forth in claim 1, wherein a portion of the gudgeon bore in which the circumferential regions complementary to the circularity deviation regions of the hinge pin are formed, has a circumferential continuous wall having minimal thickness equal at least twice of a circularity deviation of the hinge pin.

17. A door hinge as set forth in claim 1, further comprising means for preventing axial displacement of the hinge pin, the preventing means comprising a radial projection and a safety washer located on opposite axial sides of a hinge pin portion received in the gudgeon of the another of the first and second hinge halves.

18. A door hinge as set forth in claim 17, further comprising a clamp sleeve for retaining the hinge pin in the gudgeon of the one of the first and second hinge halves against rotation.

19. A door hinge as set forth in claim 1, wherein the one of the first and second hinge halves is formed with two spaced gudgeons, and the another of the first and second halves is formed with a single gudgeon located between the spaced gudgeons of the one of the first and second hinge halves, and wherein the hinge pin is secured against rotation in both gudgeons of the one of the first and second hinge halves.

20. A door hinge as set forth in claim 19, wherein the hinge pin has, along an axial length thereof, following one another stepped portions of ever increasing diameter, with a leading end portion having a smallest diameter.

* * * * *